US007138157B2

(12) United States Patent
Tomida et al.

(10) Patent No.: US 7,138,157 B2
(45) Date of Patent: Nov. 21, 2006

(54) ELECTRON EMITTING DEVICE MANUFACTURE METHOD AND IMAGE DISPLAY APPARATUS MANUFACTURE METHOD

(75) Inventors: Yasuko Tomida, Kanagawa (JP); Taku Shimoda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 540 days.

(21) Appl. No.: 10/628,419

(22) Filed: Jul. 29, 2003

(65) Prior Publication Data

US 2004/0022933 A1 Feb. 5, 2004

(30) Foreign Application Priority Data

Jul. 30, 2002 (JP) ..... 2002-221184

(51) Int. Cl.
*B05D 5/12* (2006.01)

(52) U.S. Cl. ..... 427/64; 427/66; 427/77; 427/299; 427/372.2

(58) Field of Classification Search ..... 427/58, 427/64, 66, 77, 299, 372.2
See application file for complete search history.

(56) References Cited

U.S. PATENT DOCUMENTS

| | | | | |
|---|---|---|---|---|
| 6,053,791 | A * | 4/2000 | Fujii et al. | 445/6 |
| 6,060,113 | A | 5/2000 | Banno et al. | 427/78 |
| 6,063,453 | A | 5/2000 | Tomida et al. | 427/532 |
| 6,390,873 | B1 | 5/2002 | Banno et al. | 445/6 |
| 6,419,746 | B1 | 7/2002 | Banno et al. | 118/323 |
| 6,511,358 | B1 | 1/2003 | Banno et al. | 445/24 |
| 6,511,545 | B1 | 1/2003 | Banno et al. | 118/688 |
| 2002/0015800 | A1 | 2/2002 | Miyamoto et al. | 427/553 |
| 2002/0028285 | A1 * | 3/2002 | Banno et al. | 427/77 |
| 2003/0062816 | A1 | 4/2003 | Terada et al. | 313/310 |

FOREIGN PATENT DOCUMENTS

| | | | |
|---|---|---|---|
| JP | 9-69334 | | 3/1997 |
| JP | 9-270421 | | 10/1997 |
| JP | 10-326559 | | 12/1998 |
| JP | 11-260243 | * | 9/1999 |
| JP | 2000-182513 | | 6/2000 |
| JP | 2000-231876 | * | 8/2000 |

* cited by examiner

*Primary Examiner*—Brian K. Talbot
(74) *Attorney, Agent, or Firm*—Fitzpatrick, Cella, Harper & Scinto

(57) ABSTRACT

A method for manufacturing electron emitting devices each having electrodes formed on a substrate and an electroconductive thin film connected between a pair of electrodes and having an electron emitting region is provided which can manufacture electron emitting devices having an excellent uniformity of electron emitting characteristics by improving the formation of liquid droplets to be dispensed to the substrate. In the manufacturing method, the substrate formed with the electrodes is subjected to a hydrophobic process using a silane coupling agent which contains two or more acetoxy groups in a molecule, and thereafter liquid droplets containing material for forming the electroconductive thin film are dispensed to the substrate. An image of excellent uniformity can be displayed by adopting electron emitting devices manufactured in the above manner to an image display apparatus.

16 Claims, 11 Drawing Sheets

ELECTRON EMITTING DEVICE MANUFACTURE METHOD AND IMAGE DISPLAY APPARATUS MANUFACTURE METHOD

BACKGROUND OF THE INVENTION

1. Field of the Invention

The present invention relates to a method of manufacturing electron emitting devices and a method of manufacturing an image display apparatus.

2. Related Background Art

Most of image display apparatuses used presently are cathode ray tubes (CRT's). In place of CRT's, a number of flat panel displays have been developed, studied and are commercially available, such as liquid crystal display (LCD), plasma display panel (PDP), electro luminescence display (ELD) and field emission display (FED).

An electron emitting device is used for some of the above-described display apparatuses. For example, in manufacturing an electron emitting device, a conductive thin film including an electron emitting region is formed by directly depositing conductive material on an insulating substrate by deposition techniques such as vapor deposition and sputtering. Another recent method is to dispense liquid droplets containing conductive thin film material to an insulating substrate by an ink jet method. This ink jet method does not require a vacuum system and can form a large screen device. In order to form a good electron emitting device by preventing liquid droplets from being dispensed in an ink jet manner to positions different from predetermined positions of an insulating substrate, the substrate is processed in advance with hydrophobic process agent of hexamethylsilazane (refer to Japanese Patent Application Laid-open No. 9-069334). Other methods of manufacturing a good electron emitting device include a method of adjusting the surface energy of a substrate to which liquid droplets are dispensed to have a desired surface energy by using silane coupling agent such as dimethylethoxysilane (Japanese Patent Application Laid-open No. 10-326559) or by using silane coupling agent having only a single hydrolysis group (Japanese Patent Application Laid-open No. 2000-182513).

With the method of dispensing liquid droplets after the hydrophobic process using hexamethylsilazane, however, a hydrophobic process is difficult to be performed without variations or hydrophobicity becomes too large so that liquid droplets may be shrunk, being unable to form a good electron emitting device. With the method of dispensing liquid droplets after the hydrophobic process using silane coupling agent such as dimethylethoxysilane, hydrophobicity is insufficient so that the liquid droplets may flow and expand to positions different from desired positions of a substrate or a hydrophobic process is difficult to be performed without variations, being unable to form a good electron emitting device. With the method of dispensing liquid droplets after the hydrophobic process using silane coupling agent having only a single hydrolysis group, there is only one bond between the substrate and silane coupling agent and there is no bond between silane coupling agents coupled to the substrate. Hydrophobicity is therefore insufficient so that the liquid droplets may flow and expand to positions different from desired positions of a substrate. With this method, it is therefore difficult to manufacture an electron emitting device.

SUMMARY OF THE INVENTION

It is therefore an objective of the present invention to provide a method of manufacturing electron emitting devices having an excellent uniformity of electron emitting characteristics by improving the formation of liquid droplets to be dispensed to a substrate.

It is another objective of the present invention to provide a method of manufacturing image display devices having an excellent uniformity of display characteristics by improving the formation of liquid droplets to be dispensed to a substrate.

According to one aspect of the invention, there is provided a method of manufacturing electron emitting devices each having electrodes formed on a substrate and an electroconductive thin film connected between a pair of electrodes and having an electron emitting region, comprising steps of: subjecting the substrate formed with the electrodes to a hydrophobic process using a silane coupling agent which contains two or more ac ethoxy groups in a molecule; and thereafter dispensing liquid droplets containing material for forming the electroconductive thin film to the substrate.

According to another aspect of the invention, there is provided a method of manufacturing electron emitting devices comprising steps of: dispensing liquid droplets which contain material for forming an electroconductive thin film to an area between opposing electrodes formed on a substrate; performing a heating and baking process to form the electroconductive thin film in the area between the opposing electrodes, and thereafter forming an electron emitting region in the electroconductive thin film, wherein the substrate formed with the electrodes is subjected to a hydrophobic process using a silane coupling agent which contains two or more acetoxy groups in a molecule; and thereafter the liquid droplets are dispensed to the substrate.

According to another aspect of the invention, there is provided a method of manufacturing electron emitting devices each having electrodes formed on a substrate and an electroconductive thin film connected between a pair of electrodes and having an electron emitting region, comprising steps of: subjecting the substrate formed with the electrodes to a hydrophobic process using a mixture of two or more silane coupling agents having different hydrolysis groups, and thereafter dispensing liquid droplets containing material for forming the electroconductive thin film to the substrate.

According to another aspect of the invention, there is provided a method of manufacturing electron emitting devices comprising steps of: dispensing liquid droplets which contain material for forming an electroconductive thin film to an area between opposing electrodes formed on a substrate; performing a heating and baking process to form the electroconductive thin film in the area between the opposing electrodes, and thereafter forming an electron emitting region in the electroconductive thin film, wherein the substrate formed with the electrodes is subjected to a hydrophobic process using a mixture of two or more silane coupling agents having different hydrolysis groups, and thereafter liquid droplets containing material for forming the electroconductive thin film are dispensed to the substrate.

According to another aspect of the invention, there is provided a method of manufacturing an image display apparatus comprising a step of dispensing liquid droplets which contains material forming an image display member by an ink jet method, to a substrate subjected to a hydrophobic process using a silane coupling agent which contains two or more acetoxy groups in a molecule.

According to another aspect of the invention, there is provided a method of manufacturing an image display apparatus comprising a step of dispensing liquid droplets which contains material for forming an image display member by an ink jet method, to a substrate subjected to a hydrophobic process using a mixture of two or more silane coupling agents having different hydrolysis groups.

DETAILED DESCRIPTION OF THE PREFERRED EMBODIMENTS

Figure 1A:
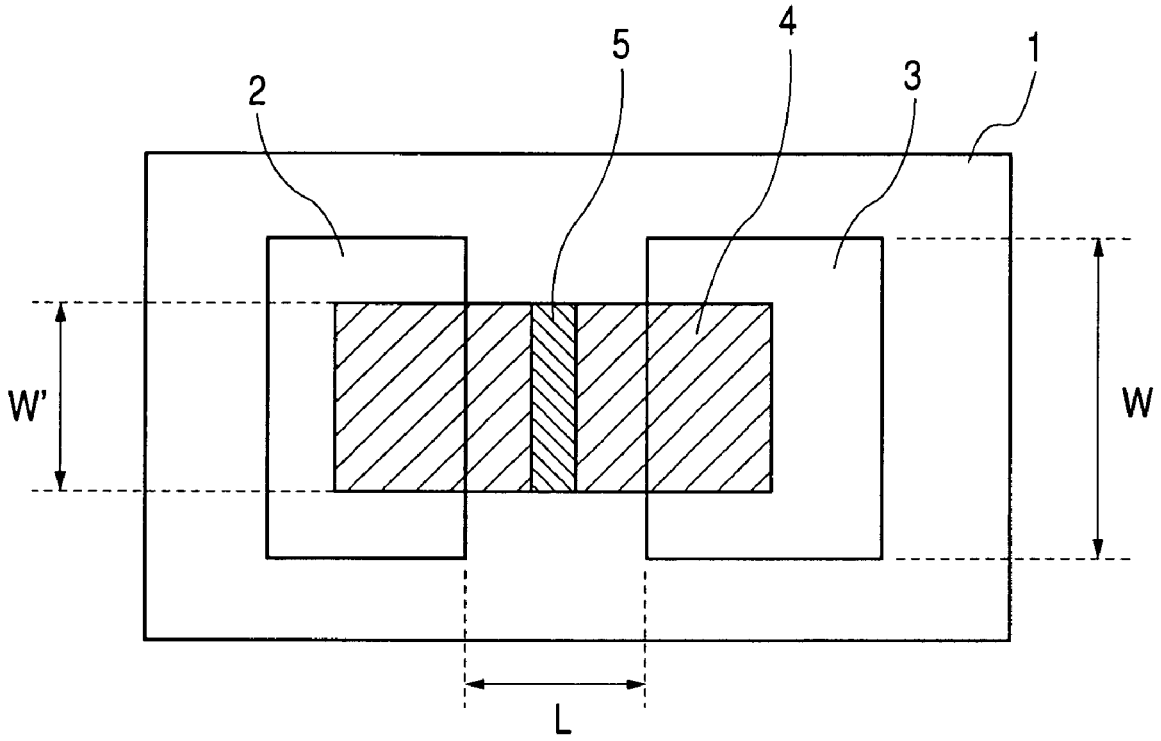
FIGS. 1A and 1B are schematic diagrams showing an example of the structure of an electron emitting device according to the invention.

The invention provides a method of manufacturing electron emitting devices each having electrodes formed on a substrate and an electroconductive thin film connected between a pair of electrodes and having an electron emitting region, comprising steps of: subjecting the substrate formed with the electrodes to a hydrophobic process using a silane coupling agent which contains two or more acetoxy groups in a molecule; and thereafter dispensing liquid droplets containing material for forming the electroconductive thin film to the substrate.

The invention also provides a method of manufacturing electron emitting devices comprising steps of: dispensing liquid droplets which contain material for forming an electroconductive thin film to an area between opposing electrodes formed on a substrate; performing a heating and baking process to form the electroconductive thin film in the area between the opposing electrodes, and thereafter forming an electron emitting region in the electroconductive thin film, wherein the substrate formed with the electrodes is subjected to a hydrophobic process using a silane coupling agent which contains two or more acetoxy groups in a molecule; and thereafter the liquid droplets are dispensed to the substrate.

In the methods of manufacturing electron emitting devices described above, the silane coupling agent is preferably diacetoxydimethylsilane.

In the methods of manufacturing electron emitting devices described above, dispensing the liquid droplets is performed preferably by an ink jet method.

The invention also provides a method of manufacturing electron emitting devices each having electrodes formed on a substrate and an electroconductive thin film connected between a pair of electrodes and having an electron emitting region, comprising steps of: subjecting the substrate formed with the electrodes to a hydrophobic process using a mixture of two or more silane coupling agents having different hydrolysis groups, and thereafter dispensing liquid droplets containing material for forming the electroconductive thin film to the substrate.

The invention also provides a method of manufacturing electron emitting devices comprising steps of: dispensing liquid droplets which contain material for forming an electroconductive thin film to an area between opposing electrodes formed on a substrate; performing a heating and baking process to form the electroconductive thin film in the area between the opposing electrodes, and thereafter forming an electron emitting region in the electroconductive thin film, wherein the substrate formed with the electrodes is subjected to a hydrophobic process using a mixture of two or more silane coupling agents having different hydrolysis groups, and thereafter liquid droplets containing material for forming the electroconductive thin film are dispensed to the substrate.

In the methods of manufacturing electron emitting devices described above, dispensing the liquid droplets is performed by an ink jet method.

In the methods of manufacturing electron emitting devices described above, one of the two or more silane coupling agents is preferably a silane coupling agent which contains two or more acetoxy groups in a molecule.

In the methods of manufacturing electron emitting devices described above, the silane coupling agent which contains two or more acetoxy groups in a molecule is preferably diacetoxydimethylsilane.

In the methods of manufacturing electron emitting devices described above, it is preferable that one of the two or more silane coupling agents contains an acetoxy group in a molecule and another contains an ethoxy group in a molecule.

The invention also provides a method of manufacturing an image display apparatus comprising a step of dispensing liquid droplets which contains material for forming an image display member by an ink jet method, to a substrate subjected to a hydrophobic process using a silane coupling agent which contains two or more acetoxy groups in a molecule.

The invention also provides a method of manufacturing an image display apparatus comprising a step of dispensing liquid droplets which contains material for forming an image display member by an ink jet method, to a substrate subjected to a hydrophobic process using a mixture of two or more silane coupling agents having different hydrolysis groups.

In the methods of manufacturing an image display apparatus described above, it is preferable that the image display member is a member disposed on the electrodes and the liquid droplets are dispensed to the electrodes.

In the methods of manufacturing an image display apparatus described above, it is preferable that the image display member is a member through which electrons flow.

In the methods of manufacturing an image display apparatus described above, it is preferable that the image display member is a material from which electrons are emitted.

In the methods of manufacturing an image display apparatus described above, the silane coupling agent to be used preferably is similar to the silane coupling agent to be used by the method of manufacturing electron emitting devices.

A preferred image display apparatus to which the invention is applied includes a liquid crystal display (LCD), an EL display (ELD), an FE display (FED), a display using surface conduction electron emitting devices to the described later, and the like.

For a liquid crystal display, a color filter is preferably used as the image display member of the invention. For an EL display, transport layers such as a hole transport layer, an amphoteric transport layer are preferably used as the image display member of the invention. For an FE display, an emitter is preferably used as the image display member of the invention. For a surface conduction electron emitting device, an electroconductive thin film having an electron emitting region is preferably used as the image display member of the invention.

The embodiments will be described in detail by taking as an example a surface conduction electron emitting device having a pair of electrodes and an electroconductive thin film having an electron emitting region formed between the electrodes.

The inventors consider important the process of dispensing liquid droplets of solution which contains material for forming an electroconductive thin film to an area between the opposing electrodes formed on a substrate, in order to manufacture electron emitting devices having an excellent uniformity of characteristics. The inventors have studied a method of dispensing liquid droplets at high precision and found that good electron emitting devices can be manufactured by dispensing liquid droplets to a substrate processed by using silane coupling agent which contains two or more acetoxy groups. The silane coupling agent containing acetoxy groups can be coupled to a glass substrate in a short time because the hydrolysis reaction of acetoxy groups is high. In addition, a reaction between hydrolyzed silane coupling agents containing two or more acetoxy groups is high. It can therefore be considered that portion of chained silane coupling agents is bonded to a substrate surface and water repellent can be presented even in the case that the substrate and silane coupling agent are unable to react each other because of stains or the like on a partial substrate surface. Therefore, electron emitting devices having a small variation and good uniformity of characteristics can be manufactured by processing a substrate with silane coupling agent having two or more acetoxy groups, improving the formation of liquid droplets and presenting sufficient hydrophobicity, even if some stains or the like are formed on the substrate surface. Improving the formation of liquid droplets means that liquid droplets can be dispensed to a substrate at desired size and with good reproductivity.

The inventors have also found that good electron emitting devices can be manufactured by dispensing liquid droplets which contain material for forming an electroconductive thin film to an area between opposing electrodes formed on a substrate, after the substrate is processed with a mixture of two or more silane coupling agents having different hydrolysis groups, i.e., a mixture of silane coupling agents having different reaction. This method is effective for the case that a surface energy of a substrate cannot be controlled to have a desired energy by using arbitrary silane coupling agent. The surface energy of a substrate can be controlled by selecting types kinds of silane coupling agents to be combined or a mixture ratio of silane coupling agents. It is preferable that at least one of mixed silane coupling agents is silane coupling agent which contains two or more acetoxy groups. For example, if a hydrophobic process using diacetoxydimethylsilane lowers the substrate surface energy and the formation of liquid droplets is poor, the formation of liquid droplets can be improved by processing a substrate with a mixture of diacetoxydimethylsilane and diethoxydimethylsilane.

(Hydrophobic Process Using Silane Coupling Agent)

Silane coupling agent which contains two or more acetoxy groups may be diacetoxydimethylsilane, diacetoxydiphenylsilane, diacetoxymethylphenylsilane, diacetoxymethylsilane, diacetoxymethylvinylsilane, triacetoxymethylsilane, triacetoxyphenylsilane, triacetoxyvinylsilane or the like. Diacetoxymethylsilane is preferably used among others.

Silane coupling agent which contains a hydrolysis group other than the acetoxy group may be silane coupling agent which contains a methoxy group, an ethoxy group, a butoxy group, a 2-methoxyethoxy group, an amino group, a vinyl group, a chlorine group, a bromine group, an allyloxy group, a diethylaminoxy group or the like. Silane coupling agent which contains an ethoxy group is preferably used among others.

In order to perform a hydrophobic process for a substrate formed with opposing electrodes by using silane coupling agent, silane coupling agent is attached to the substrate. Attaching the silane coupling agent may be performed by well known methods, for example, a method of attaching undiluted solution of silane coupling agent in the form of vapor to a substrate, a method of immersing a substrate into a mixture of silane coupling agent and alcohol aqueous solution, a method of blowing and coating a mixture of silane coupling agent and alcohol aqueous solution on a substrate. After silane coupling agent is attached to the substrate, the substrate is maintained at a room temperature or a baking process is performed at about 120° C. to obtain a hydrophobic substrate.

If a mixture of two or more silane coupling agents having different hydrolysis groups is used, this mixture is preferably used as soon as possible after mixing.

(Conductive Thin Film Formation)

In order to form an electroconductive thin film between opposing electrodes after the hydrophobic process is performed, liquid droplets of solution which contains electroconductive thin film material are dispensed to an area between the opposing electrodes. The ink jet method is suitable for this purpose. The ink jet method includes a method of generating liquid droplets by mechanical impacts formed by a piezoelectric element or the like, a bubble jet method of generating liquid droplets by heating and boiling solution with a fine heater or the like, or other methods.

In the liquid droplet dispensing process, the number of liquid droplets to be dispensed to the same position on a substrate is not limited only to one, but a desired amount of electroconductive thin film material may be applied to a substrate by dispensing a plurality of liquid droplets.

The electroconductive thin film material usable in the invention is metal compound, e.g., metal salt or metal complex of platinum or palladium. The metal density of metal compound is generally in the range from 0.1% or more to 8% or less, although this range may vary more or less depending upon the kind of metal compound.

If the ink jet method is used as the liquid droplet dispensing method, it is preferable to jet out aqueous solution from an ink jet surface and to use water soluble metal compound such as ethanol amine carboxylic acid metal complex.

Solution which contains electroconductive thin film material is prepared by dissolving the metal compound in water. It is preferable that the solution contains also water soluble polyhydric alcohol, water soluble monohydric alcohol, polyvinyl alcohol or the like.

The electroconductive thin film can be formed by subjecting the solution containing electroconductive thin film material dispensed to a substrate, to a heating and baking process. In the heating and baking process, first a drying process such as known natural drying, air blow drying and heat drying is performed by placing the substrate in an electric dryer for about 30 seconds to 2 minutes at a temperature of, for example, 70° C. to 130° C. Next, a baking process is performed by using a well-known heating means. The baking temperature is set to such a value sufficient for decomposing organic metal compound. The drying process and baking process may be performed continuously and at the same time and they are not required to be performed independently.

(Surface Conduction Electron Emitting Device)

Description will be given on a method of manufacturing a surface conduction electron emitting device.

Figure 1B:
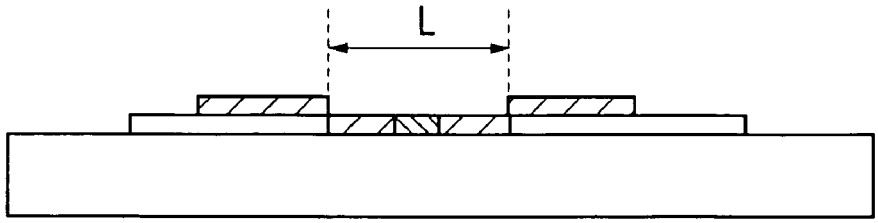

With reference to the schematic diagrams of FIGS. 1A and 1B, the device structure proposed by M. Hartwell will be described which is a typical device structure of a surface conduction electron emitting device.

Referring to FIGS. 1A and 1B, reference numeral 1 represents a substrate made of glass or the like. The size and thickness of the substrate are properly set depending upon the number of electron emitting devices to be formed on the substrate, the designed shape of each device, the dynamical conditions of the structure durable against the atmospheric pressure and necessary for maintaining vacuum the inside of an electron source envelope partially constituted of the substrate, and other conditions.

Inexpensive soda lime glass is generally used. It is preferable to use a substrate made of soda lime glass on which a silicon oxide film having a thickness of about 0.5 μm is formed as a sodium block layer. A substrate made of glass which contains less sodium or a quartz substrate may also be used.

The device electrodes 2 and 3 are made of general electroconductive material. The electroconductive material is preferably metal such as Ni, Cr, Au, Mo, Pt and Ti or compound of Pd—Ag or the like. The electroconductive material may be selected from a printed conductor made of metal oxide, glass and the like and a transparent conductor such as ITO. The thickness of the device electrode is preferably several tens nm to several μm.

A device electrode space L, device electrode length W and shape of the device electrodes 2 and 3 are properly designed depending upon the application field of devices. It is preferable that the device electrode space L is in the range from several hundreds nm to 1 mm, or more preferably in the range from 1 μm to 100 μm when a voltage applied between the device electrodes is taken into consideration. It is preferable that the device electrode length W is in the range from several pm to several hundreds pm when the electrode resistance and electron emission characteristics are taken into consideration.

The device electrode may be formed by coating paste which contains commercially available metal particles such as platinum Pt by a printing method such as an offset printing method. In order to form a more precise pattern, photosensitive paste which contains Pt or the like may be coated by a printing method such as a screen printing method, and exposed and developed by using a photo mask.

Thereafter, an electroconductive thin film 4 as an electron source is formed overriding the device electrodes 2 and 3. It is preferable to use as the electroconductive thin film a fine particle film made of fine particles in order to obtain good electron emission characteristics. The thickness of the electroconductive thin film is properly set depending upon the step coverage relative to the device electrodes 2 and 3, the resistance between the device electrodes, and the forming process conditions to be described later. The thickness is preferably in the range from 1 nm to several hundreds nm or more preferably in the range from 1 nm to 50 nm.

According to the studies made by the inventor, although palladium Pd is generally suitable for the electroconductive thin film material, the invention is not limited only thereto. The film forming method may be a sputtering method, a solution coating and baking method, and other methods.

In the embodiments to be described later, organic palladium solution is coated and thereafter baked to form a palladium oxide PdO film.

After the conducive film 4 is formed, an energization forming process is performed to form an electron emitting region 5 by supplying an electric power to the electroconductive film and form fissures in the film, to thereby form a surface conduction electron emitting device. After the forming process, an activation process is preferably performed in order to improve the electron emission efficiency.

In the embodiments, after the electroconductive thin film was formed, an electric power was supplied to the electroconductive film under the reducing atmosphere with the existence of hydrogen to heat the electroconductive film and change the electroconductive film to the palladium Pd film and form fissures in the film. In this manner, the electron emitting region 5 was formed.

In FIGS. 1A and 1B, the electron emitting region 5 is drawn in a rectangle shape in the center of the electroconductive thin film 4 for the purpose of simplicity. The actual position and shape of the electron emitting region are not drawn with high fidelity.

EMBODIMENTS

First Embodiment

An electron emitting device of the first embodiment was formed having the structure shown in FIGS. 1A and 1B. FIG. 1A is the plan view of the device, and FIG. 1B is the cross sectional view thereof. In FIGS. 1A and 1B, reference numeral 1 represents an insulating substrate, 2 and 3 represent device electrodes for applying a voltage to the device, 4 represents a thin film having an electron emitting region, and 5 represents an electron emitting region. L represents a device electrode space between the device electrodes 2 and 3, W represents a width of the device electrode, and W' represents a width of the device.

With reference to FIGS. 2 to 6, a method of manufacturing an electron emitting device of the embodiment will be described. FIGS. 2 to 6 are plan views of a substrate having electron emitting devices disposed in a matrix shape. In FIGS. 2 to 6, reference numeral 21 represents an electron source substrate, 22 and 23 represent device electrodes, 24 represents Y-direction wiring lines, 25 represents insulating films, 26 represent X-direction wiring lines, 27 represents surface conduction electro emitting films constituting electron emitting regions. With reference to FIGS. 2 to 6, the method of manufacturing the device will be described.

(Glass Substrate and Device Electrodes Formation)

Figure 2:
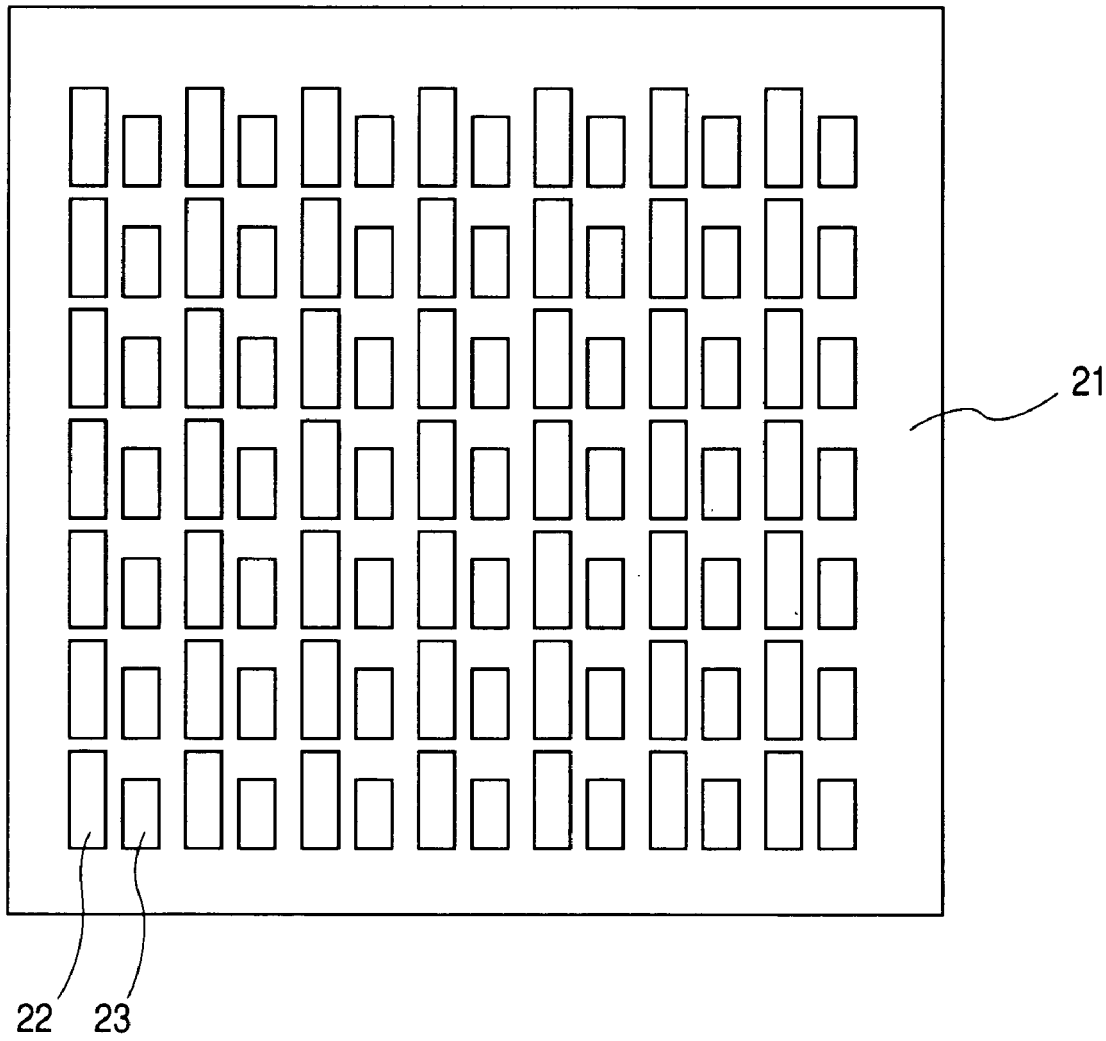
FIG. 2 is a diagram illustrating an example of an electron emitting device manufacture process according to the invention at the stage that opposing electrodes are formed on a substrate.

As shown in FIG. 2, opposing electrodes 22 and 23 were formed on the substrate 21. The number of pixels are 7×7 so that there are 49 pairs of opposing electrodes.

As the substrate 21, glass of PD-200 (manufactured by ASAHI GLASS COMPANY) having small alkaline components was used which had a thickness of 2.8 mm. As a sodium block layer, an $SiO_2$ film having a thickness of 100 nm was coated on the substrate and baked.

The device electrodes 22 and 23 were formed in the following manner. On the glass substrate 21, an underlying layer of titanium Ti was formed to a thickness of 5 nm, and on the Ti layer, a layer of platinum Pt was formed to a thickness of 40 nm, respectively by sputtering. Photoresist was coated and patterned by a series of photolithography processes including exposure, development and etching.

In this embodiment, the device electrode space L was set to 10 μm and the width W was set to 100 μm.

(Lower Wiring Lines and Insulating Films Formation)

The material of X- and Y-direction wiring lines is desired to have a low resistance so that a generally uniform voltage is applied to a number of surface conduction electron emitting devices. The material, film thickness and width and the like are properly selected.

Figure 3:
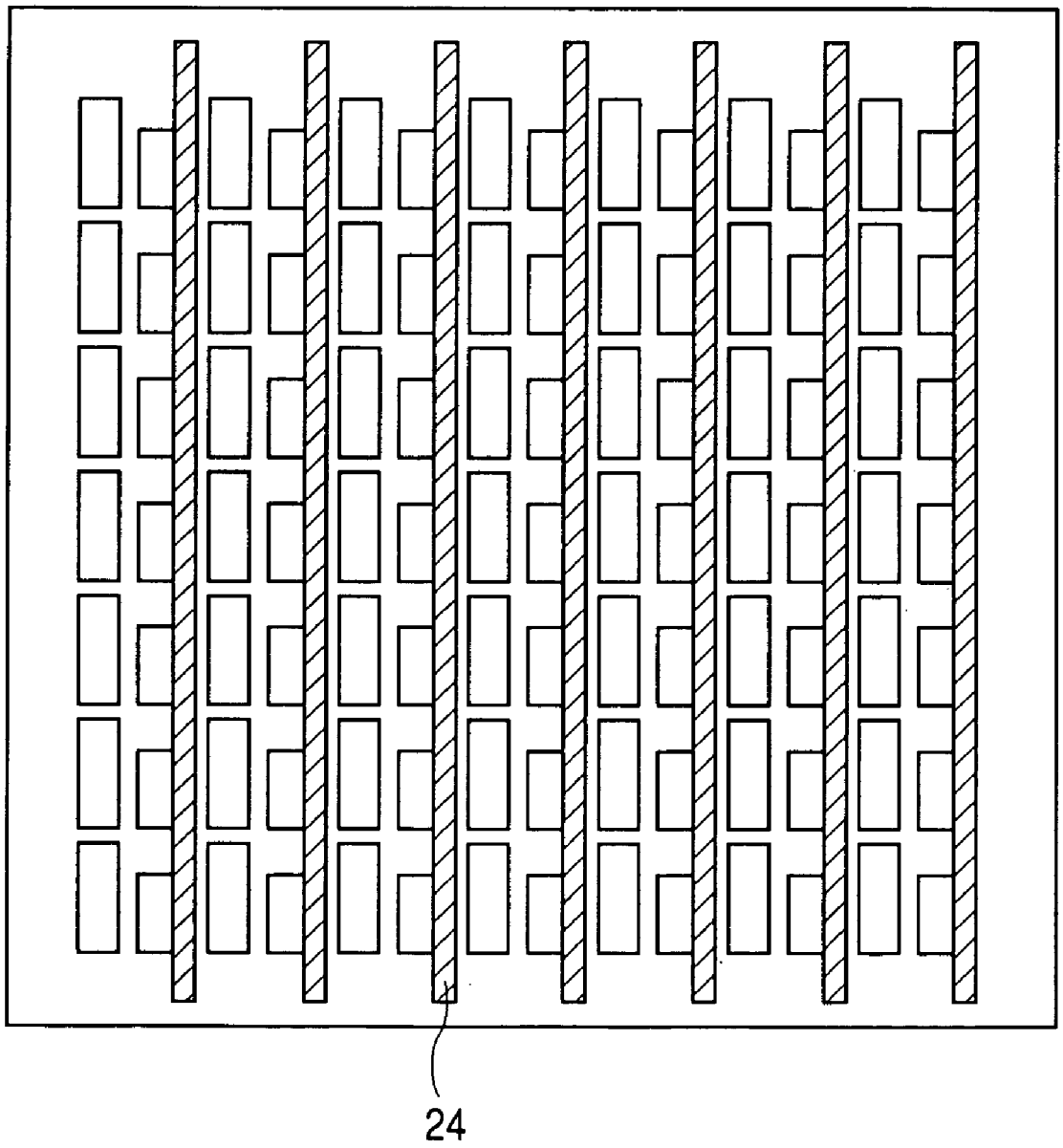
FIG. 3 is a diagram illustrating an example of the electron emitting device manufacture process at the stage that Y-direction wiring lines are formed, following the stage shown in FIG. 2.

As shown in FIG. 3, Y-direction common wiring lines (lower wiring lines) 24 were formed having a line pattern interconnecting ones 23 of the device electrodes. Photo paste ink of silver Ag was used and screen-printed. After the ink was dried, a predetermined pattern was exposed and developed. Thereafter, the pattern was baked at a temperature of about 480° C. to form the wiring lines.

The wiring line thickness was about 10 μm and the width was about 50 μm. The opposite end portions of the wiring line were made wider because they were used as the wiring lead electrodes.

(Insulating Film Formation)

Figure 4:
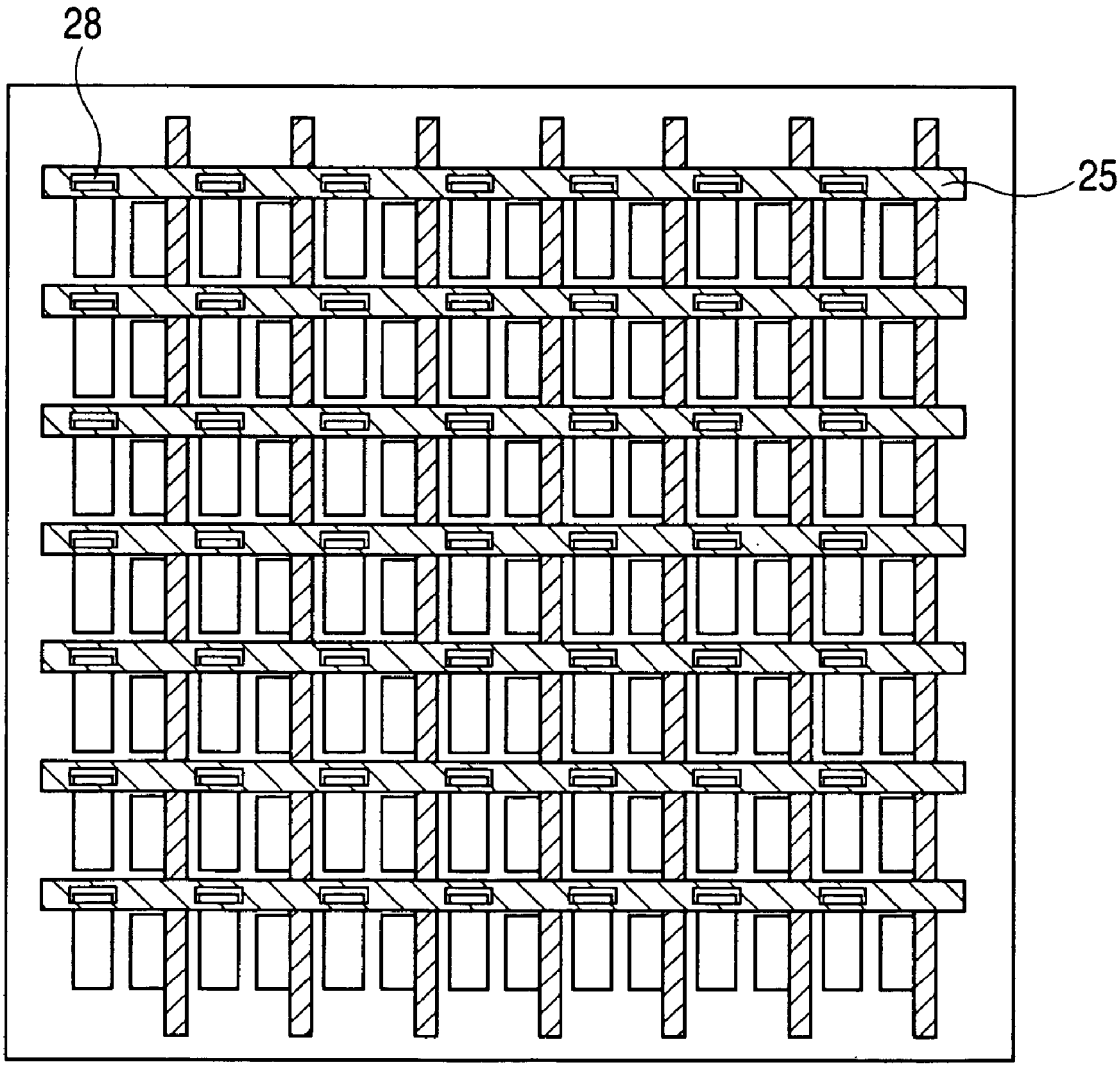
FIG. 4 is a diagram illustrating an example of the electron emitting device manufacture process at the stage that insulating films are formed, following the stage shown in FIG. 3.

As shown in FIG. 4, interlayer insulating films 25 were formed to insulate the upper and lower wiring lines. The interlayer insulating films were formed under the X-direction wiring lines (upper wiring lines) to be described later, covering the cross areas with the previously formed Y-direction wiring lines (lower wiring lines) and having contact holes 28 for electrically connecting the upper wiring lines (X-direction wiring lines) and the others 22 of the device electrodes.

Photosensitive glass paste having PbO as main components were screen-printed and exposed and developed. This process was repeated four times. The glass paste was finally baked at a temperature of about 480° C. The thickness of the interlayer insulating film was set to about 30 μm and the width was set to about 150 μm.

(Upper Wiring Lines Formation)

Figure 5:
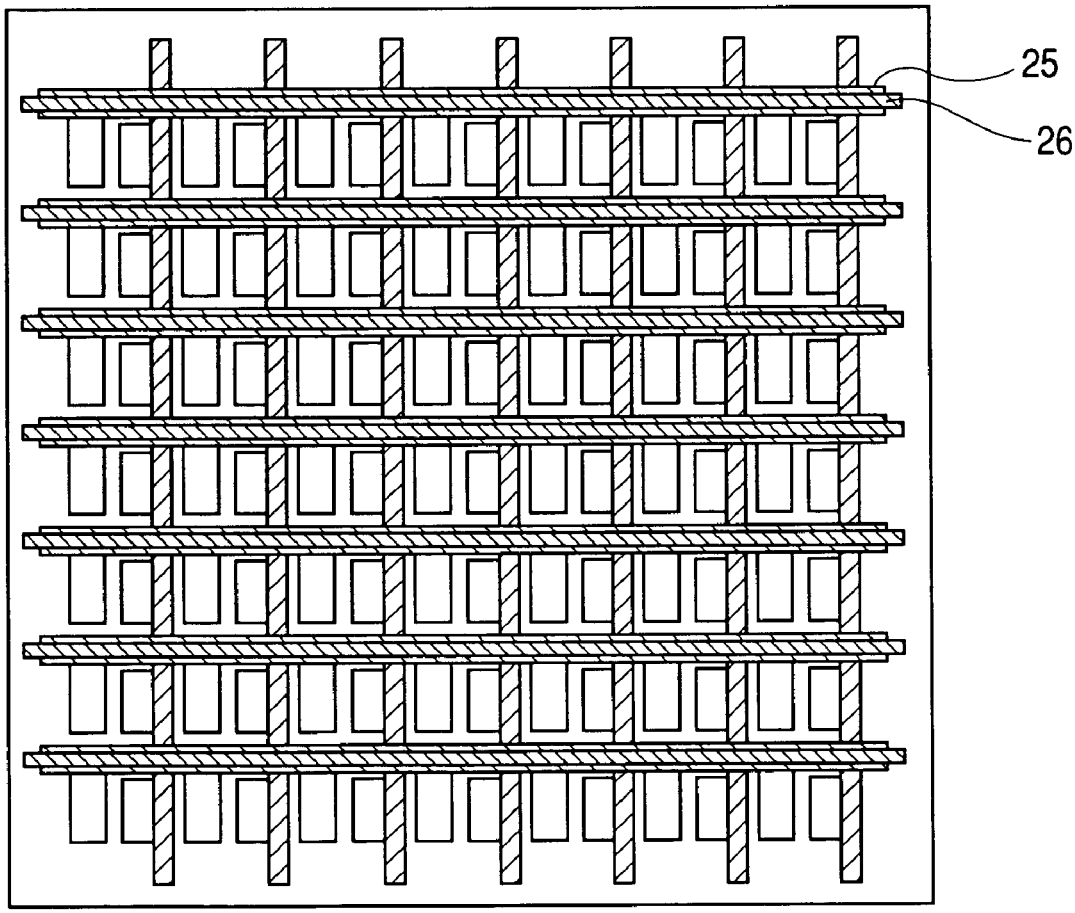
FIG. 5 is a diagram illustrating an example of the electron emitting device manufacture process at the stage that X-direction wiring lines are formed, following the stage shown in FIG. 4.

As shown in FIG. 5, the X-direction wiring lines (upper wiring lines) 26 were formed on the insulating films 25 by screen-printing Ag paste ink and drying the ink. This process was repeated twice and thereafter the ink was baked at a temperature of about 480° C. The X-direction wiring lines cross the Y-direction wiring lines (lower wiring lines) 24, with the insulating films 25 being interposed therebetween. The X-direction wiring lines are connected to the others 22 of the device electrodes via the contact holes 28 formed through the insulating films.

The X-direction wiring lines connected to the other device electrodes 22 are used as scan electrodes after the devices are formed as a panel.

The thickness of the X-wiring line was set to about 15 μm. Lead wiring lines to an external drive circuit were formed in the similar manner.

Although not shown, lead terminals to the external drive circuit were formed in the similar manner.

With these processes, the substrate with XY matrix wiring lines was formed.

(Hydrophobic Process)

After the substrate was cleaned to a sufficient degree, the substrate surface was subjected to the hydrophobic process by using diacetoxy dimethyl silane. More specifically, the substrate was placed in a vessel containing saturated vapor of diacetoxydimethylsilane and maintained for 30 minutes at a room temperature (about 25° C.). The substrate was picked up from the vessel and heated for 30 minutes at 120° C. to couple the silane coupling agent to the substrate.

(Device Films Formation)

Figure 6:
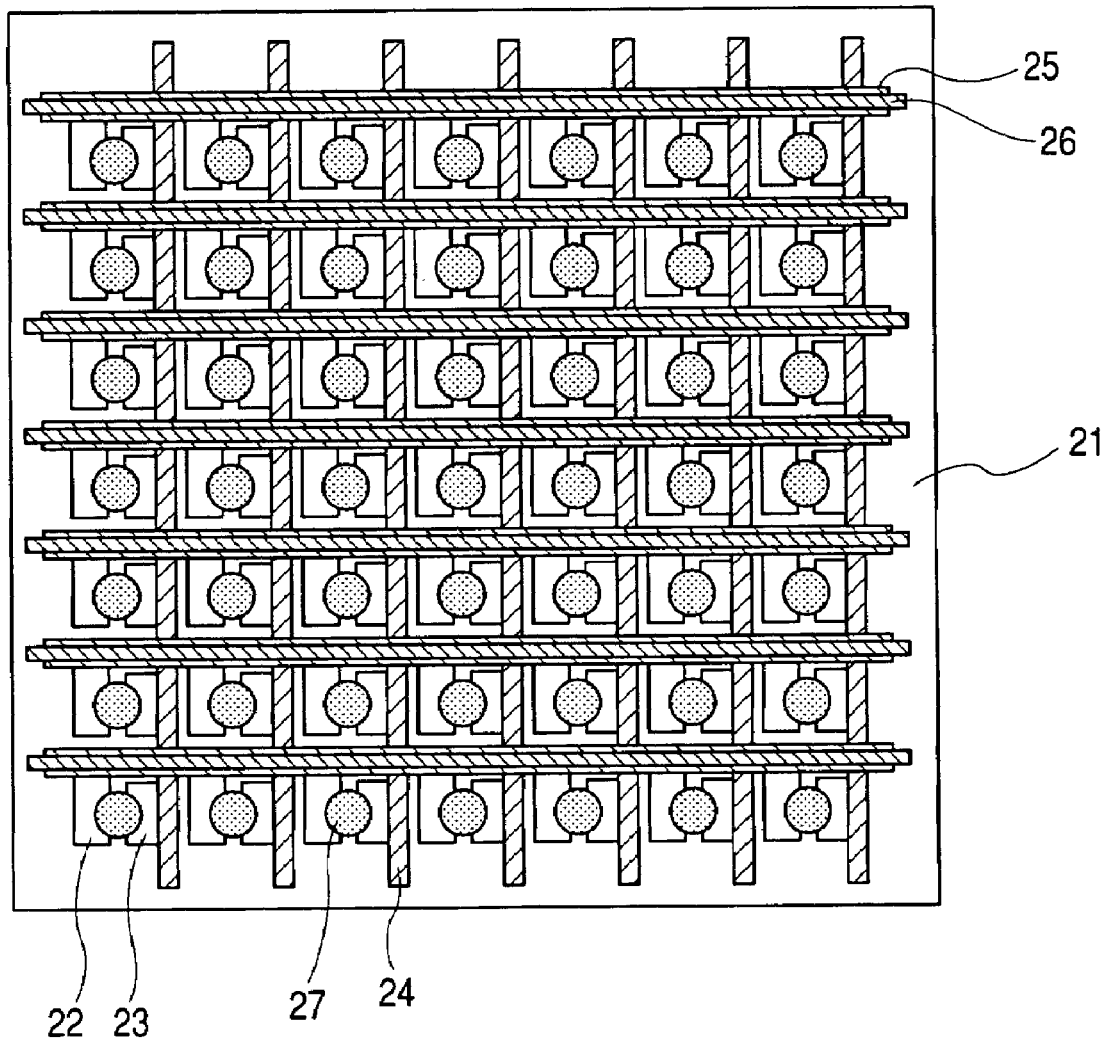
FIG. 6 is a diagram illustrating an example of the electron emitting device manufacture process at the stage that electron emitting devices are formed, following the stage shown in FIG. 5.

Thereafter, as shown in FIG. 6, device films 27 were formed between device electrodes by an ink jet coating method. In order to compensate for a two-dimensional variation in respective device electrodes on the substrate, the layout displacement of the pattern was measured at several points of the substrate. The displacement amounts of respective measured points were approximated to a straight line to interpolate the points. In this state, the device films were coated to remove the position displacement of all pixels and coat the films at corresponding positions.

More specifically, palladium-proline complex 1.0 mass %, 88% saponified polyvinyl alcohol (average polymerization degree of 500) 0.1 mass %, ethylene glycol 1.0 mass %, and 2-propanol 30 mass % were dissolved in water and filtered with a membrane filter having a pore size of 0.25 μm to prepare palladium compound solution. This solution was dispensed to the space between the electrodes by adjusting the dot diameter to 60 μm of an ink jetting apparatus. In this manner, fortynine electron emitting devices were formed. The substrate was heated for 15 minutes in an oven at a temperature of 350° C. in an atmospheric atmosphere to decompose and deposit the metal compound on the substrate so that the PdO films as the electron emitting thin films were formed.

The length of the manufactured electron emitting device, i.e. the liquid droplet diameter of solution containing electroconductive thin film material, was measured with an optical microscope. The average liquid droplet diameter of the fortynine devices was 59 μm and a variation was 3%.

(Reduction Forming)

In this process called a forming process, the electroconductive thin films are subjected to the energization process to form fissures in each film and form an electron emitting region.

More specifically, a lid like a food is placed on the substrate, covering the substrate excepting the lead electrodes in the peripheral area of the substrate. A vacuum space is formed between the lid and substrate. A voltage is applied between the X-Y-direction wiring lines from an external power source via the electrode terminals. By locally destructing, deforming or decomposing the electroconductive thin film, an electron emitting region having a high resistance can be formed.

If the energization and heating are performed in a vacuum atmosphere containing hydrogen gas more or less, reduction by hydrogen is enhanced so that palladium oxide PdO is transformed to a palladium Pd film.

When this transform occurs, fissures are formed partially by the film reduction and contraction, and the position and shape of fissures are greatly influenced by the uniformity of original films.

In order to suppress a variation in the characteristics of a number of devices, it is preferable that the fissures are formed in the central area of the film and have a linear shape as much as possible.

With this forming, electrons are emitted from the region near the fissures upon application of a predetermined voltage. However, the electron generation efficiency is low at this stage.

The resistance value Rs of the obtained electroconductive thin film was $10^2$ Ω to $10^7$ Ω.

Figure 7A:
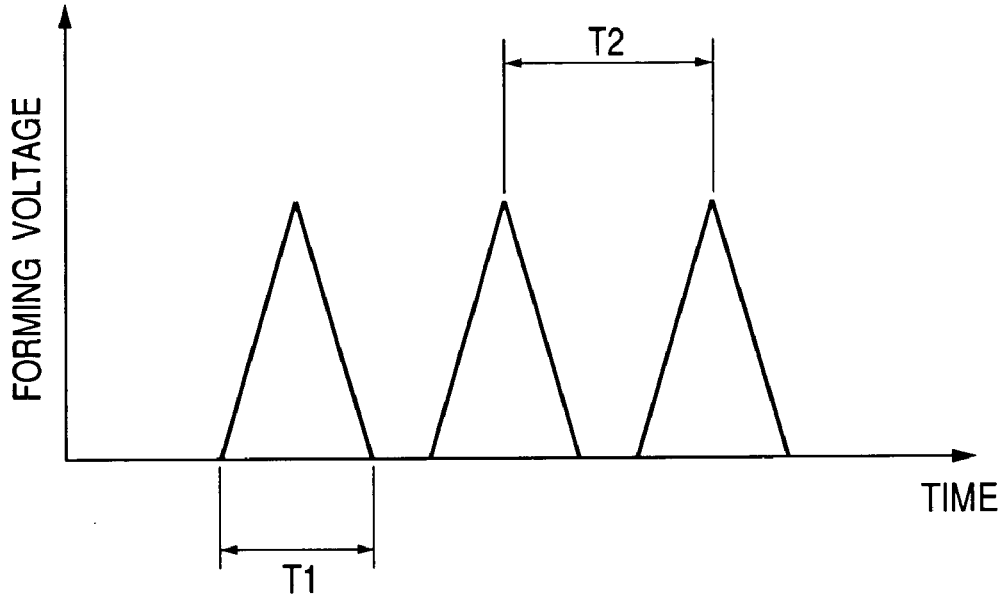
FIGS. 7A and 7B are graphs showing examples of waveforms of an energization forming voltage.
Figure 7B:
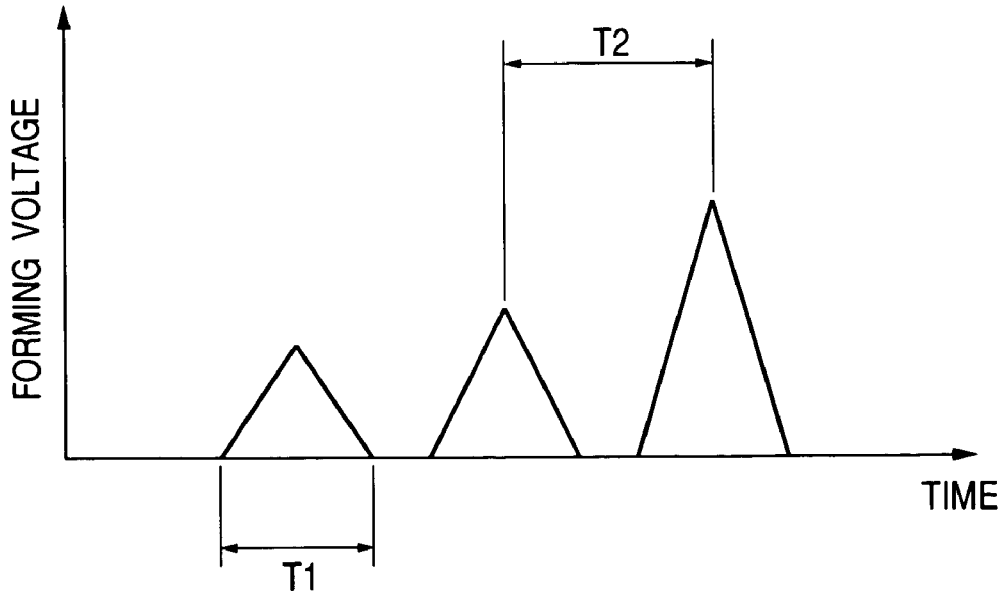

The voltage waveform used in the forming process will be described briefly. FIGS. 7A and 7B show examples of a voltage waveform.

The applied voltage has a pulse waveform. Pulses having a constant pulse wave height voltage are applied (FIG. 7A) or pulses gradually raising its pulse wave height voltage are applied (FIG. 7B).

In FIG. 7A, T1 and T2 represent a pulse width and a pulse interval of voltage waveforms. T1 is set to 1 μsec to 10 msec and T2 is set to 10 μsec to 100 msec. The wave height of a triangular wave (peak voltage during forming) is properly set.

In FIG. 7B, T1 and T2 are set in the similar manner to FIG. 7A. The wave height of a triangular wave (peak voltage during forming) is raised, for example, at about a 0.1 V step.

The forming process is terminated in the following manner. A pulse voltage, for example, of about 0.1 V, not locally destructing or deforming the electroconductive film, is inserted between forming pulses to measure the device current and a resistance value. When the resistance value becomes 1000 times or larger than the resistance value before the forming process, the forming process is terminated.

(Activation Carbon Deposition)

As described earlier, the electron emission efficiency is low if only the forming process is performed. In order to improve the electron emission efficiency, it is desired to subject the device to a process called an activation process.

This process is performed in the following manner. Similar to the forming process, a lid like a hood is placed on the substrate to form a vacuum space with the existence of organic compound between the lid and substrate. A pulse voltage is externally applied via the XY wiring lines a plurality of times to the device electrodes. By introducing gas which contains carbon atoms, carbons or carbon compound is deposited as a carbon film in the area near the fissures.

In this process, tolunitrile is used as the carbon source and introduced into a vacuum space via a slow leak valve, the vacuum degree being maintained at $1.3\times10^{-4}$ Pa. The pressure of the introduced tolunitrile is preferably about $1\times10^{-5}$ Pa to $1\times10^{-2}$ Pa although it depends to some degree on the shape, components and the like of the vacuum chamber.

Figure 8A:
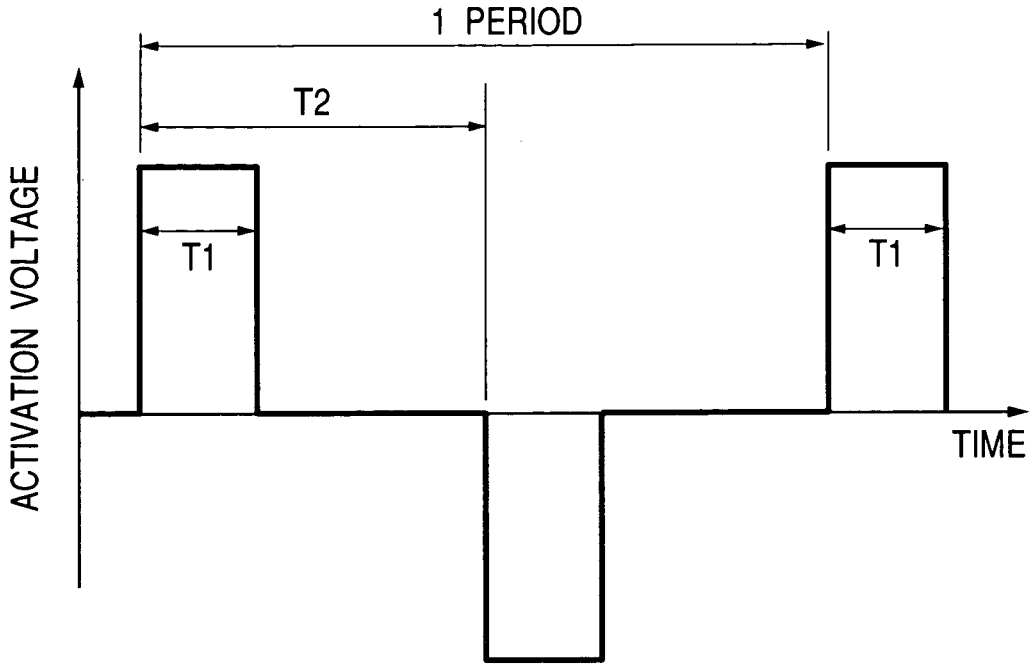
FIGS. 8A and 8B are graphs showing preferred examples of waveforms of an activation voltage used by an activation process of an electron emitting device.
Figure 8B:
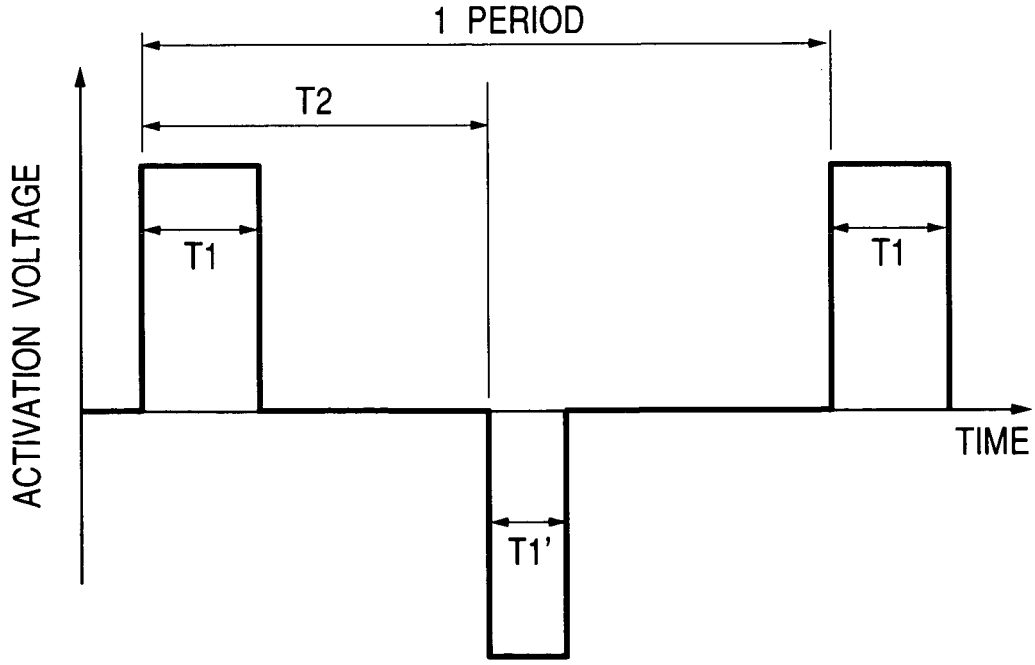

FIGS. 8A and 8B show preferred examples of a voltage used in the activation process. The maximum voltage value to be supplied is properly selected in the range from 10 to 20 V. In FIG. 8A, T1 represents a pulse width of positive and negative voltage waveforms, and T2 represents a pulse interval. The absolute values of the positive and negative voltages are the same. In FIG. 8B, T1 and T1' represent pulse widths of positive and negative voltage waveforms, and T2 represents a pulse interval, where T1>T1'. The absolute values of the positive and negative voltages are the same.

As a positive voltage is applied to one device electrode 3 by using a measurement and evaluation apparatus not shown, a positive device current If flows from the one device electrode 3 to another device electrode 2. When the emission current Ie reaches near its saturation point after about 60 minutes, the power is turned off and the slow leak valve is closed to terminate the activation process.

With the above processes, a substrate having electron source devices can be formed.

(Substrate Characteristics)

The emission current Ie of each of the fortynine devices of the embodiment was measured by applying a voltage of 12 V between device electrodes. The average emission current was 0.6 μA and the average electron emission efficiency was 0.15%. Good uniformity of devices was obtained and a good variation of 9% in Ie of respective devices was obtained.

Second Embodiment

Electron emitting devices of the second embodiment were manufactured in the method similar to the first embodiment, excepting that diacetoxymethylphenylsilane was used in place of diacetoxydimethylsilane as the silane coupling agent.

The length of the manufactured electron emitting device, i.e. the liquid droplet diameter of solution containing electroconductive thin film material, was measured with an optical microscope similar to the first embodiment. The average liquid droplet diameter of the fortynine devices was 57 μm and a variation was 4%.

The electron emission characteristics were measured in a manner similar to the first embodiment. The emission current Ie of each device was measured by applying a voltage of 12 V between device electrodes. The average emission current was 0.6 μA and the average electron emission efficiency was 0.16%. Good uniformity of devices was obtained and a good variation of 9% in Ie of respective devices was obtained.

Third Embodiment

Electron emitting devices of the third embodiment were manufactured in the method similar to the first embodiment, excepting that diacetoxydiphenylsilane was used in place of diacetoxydimethylsilane as the silane coupling agent.

The length of the manufactured electron emitting device, i.e. the liquid droplet diameter of solution containing electroconductive thin film material, was measured with an optical microscope similar to the first embodiment. The average liquid droplet diameter of the fortynine devices was 57 μm and a variation was 2%.

The electron emission characteristics were measured in a manner similar to the first embodiment. The emission current Ie of each device was measured by applying a voltage of 12 V between device electrodes. The average emission current was 0.7 μA and the average electron emission efficiency was 0.18%. Good uniformity of devices was obtained and a good variation of 6% in Ie of respective devices was obtained.

Fourth Embodiment

Electron emitting devices of the fourth embodiment were manufactured in the method similar to the first embodiment, excepting that mixture liquid of diacetoxydimethylsilane and diethoxydimethylsilane of 5:95 (mass ratio) was used in place of diacetoxydimethylsilane as the silane coupling agent.

The length of the manufactured electron emitting device, i.e. the liquid droplet diameter of solution containing electroconductive thin film material, was measured with an optical microscope similar to the first embodiment. The average liquid droplet diameter of the fortynine devices was 61 μm and a variation was 4%.

The electron emission characteristics were measured in a manner similar to the first embodiment. The emission current Ie of each device was measured by applying a voltage of 12 V between device electrodes. The average emission current was 0.6 μA and the average electron emission efficiency was 0.16%. Good uniformity of devices was obtained and a good variation of 11% in Ie of respective devices was obtained.

Fifth Embodiment

Electron emitting devices of the fifth embodiment were manufactured in the method similar to the first embodiment, excepting that mixture liquid of diacetoxydimethylsilance and diethoxydimethylsilane of 1:99 (mass ratio) was used in place of diacetoxydimethylsilane as the silane coupling agent.

The length of the manufactured electron emitting device, i.e. the liquid droplet diameter of solution containing electroconductive thin film material, was measured with an optical microscope similar to the first embodiment. The average liquid droplet diameter of the fortynine devices was 63 μm and a variation was 5%.

The electron emission characteristics were measured in a manner similar to the first embodiment. The emission current Ie of each device was measured by applying a voltage of 12 V between device electrodes. The average emission current was 0.6 μA and the average electron emission efficiency was 0.16%. Good uniformity of devices was obtained and a good variation of 12% in Ie of respective devices was obtained.

Sixth Embodiment

Figure 11A:
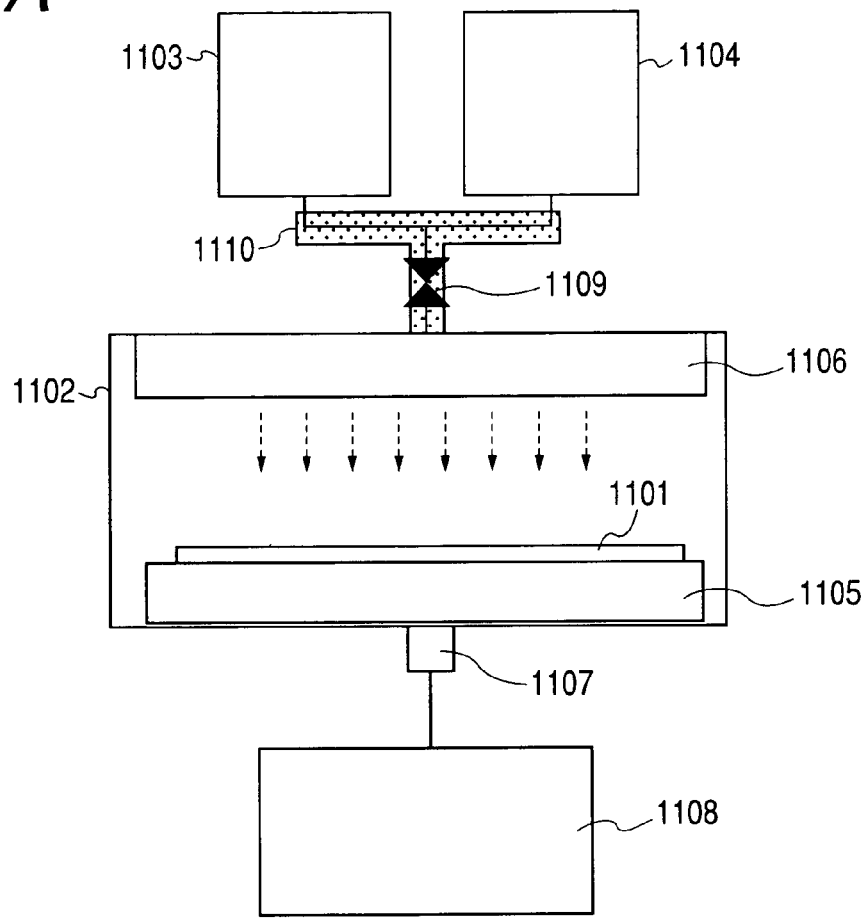
FIGS. 11A and 11B are schematic diagram showing a system used for surface treatment according to sixth and seventh embodiments.
Figure 11B:
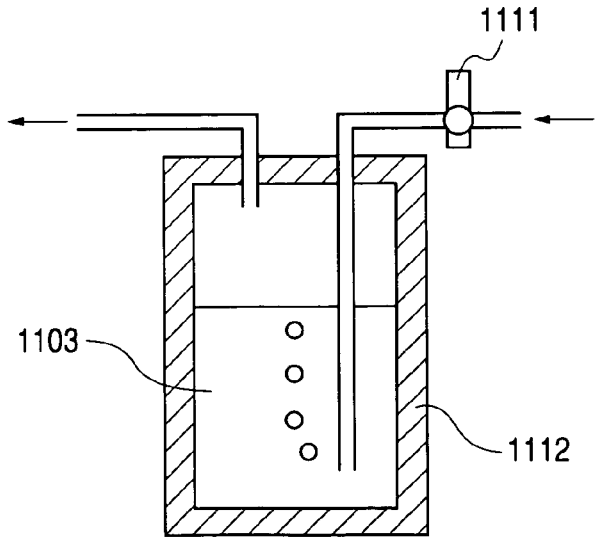

In this embodiment, a large scale substrate was processed by using the system shown in FIGS. 11A and 11B. In FIG. 11A, reference numeral 1101 represents a substrate having device electrodes similar to the first embodiment corresponding to the number of pixels of 200×200, 1102 represents a process chamber for placing the substrate therein, reference numerals 1103 and 1104 represent process agent supply containers for supplying process agents to the process container, 1105 represents a substrate heating heater, and 1106 represents process agent input ports having the mechanism of branching a number of introducing nozzles and diffusing process agent from stainless meshes. Reference numeral 1107 represents a process agent exhaust port, 1108 represents a process agent exhaust pump for exhausting the process agent from the process chamber, 1109 represents an open/close valve, and 1110 represents a tube heating heater.

A supply system such as shown in FIG. 11B is disposed in the process agent supply chamber 1103 which contains process agent and bubbling carrier gas. Reference numeral 1111 represents a flow meter for adjusting a flow rate of carrier gas, and 1112 represents a heater capable of setting the flow of the process agent supply container to a desired temperature. Nitrogen gas was used as the carrier gas. The process agent supply container 1104 has the same structure as that of the process agent supply container 1103.

In this embodiment, diacetoxydimethylsilane as the process agent was accommodated in the process agent supply container 1103, and the heater 1112 was set to 50° C., and the process substrate heating heater 1105 and tube heating heater 1110 were set to 80° C.

The substrate 1101 cleaned to a sufficient degree was placed on the heater 1105 and the inside of the process chamber 1102 was depressured to 1.0 kPa with the exhaust pump 1108. The heater 1105 was raised to 130° C.

While the exhaust pump 1108 was operated, the valve 1109 was opened to flow carrier gas at 10 L/min to blow the process agent to the substrate 1101 to be reacted with it. A reaction process time was set to 3 minutes.

After 3 minutes, the valve 1109 was closed and the unreacted process agent was removed with the exhaust pump 1108. The pressure in the process chamber when the valve was closed was about 8 kPa. Thereafter, an atmospheric pressure was recovered in the process chamber 1102 to pick up the substrate 1101.

Electron emitting devices of the sixth embodiment were manufactured by using the processes similar to those of the first embodiment after the above-described hydrophobic process.

The length of the manufactured electron emitting device, i.e. the liquid droplet diameter of solution containing electroconductive thin film material, was measured with an optical microscope similar to the first embodiment. The average liquid droplet diameter of the fortynine devices was 61 μm and a variation was 2%.

The electron emission characteristics were measured in a manner similar to the first embodiment. The emission current Ie of each device was measured by applying a voltage of 12 V between device electrodes. The average emission current was 0.6 μA and the average electron emission efficiency was 0.15%. Good uniformity of devices was obtained and a good variation of 9% in Ie of respective devices was obtained.

Seventh Embodiment

Electron emitting devices of the seventh embodiment were manufactured by using the substrate having device electrodes similar to the first embodiment corresponding to the number of pixels of 200×200, accommodating diacetoxydimethylsilane in the process agent chamber 1103 shown in FIG. 11B and diethoxydimethylsilane in the process agent supply chamber 1104, and using the processes similar to the sixth embodiment.

The length of the manufactured electron emitting device, i.e. the liquid droplet diameter of solution containing electroconductive thin film material, was measured with an optical microscope similar to the first embodiment. The average liquid droplet diameter of the fortynine devices was 62 μm and a variation was 3%.

The electron emission characteristics were measured in a manner similar to the first embodiment. The emission current Ie of each device was measured by applying a voltage of 12 V between device electrodes. The average emission current was 0.6 μA and the average electron emission efficiency was 0.16%. Good uniformity of devices was obtained and a good variation of 10% in Ie of respective devices was obtained.

Eighth Embodiment

An image display apparatus was manufactured by using the electron emitting devices of the first embodiment. This manufacture method will be described with reference to FIG. 9.

(Sealing-panelling)

Figure 9:
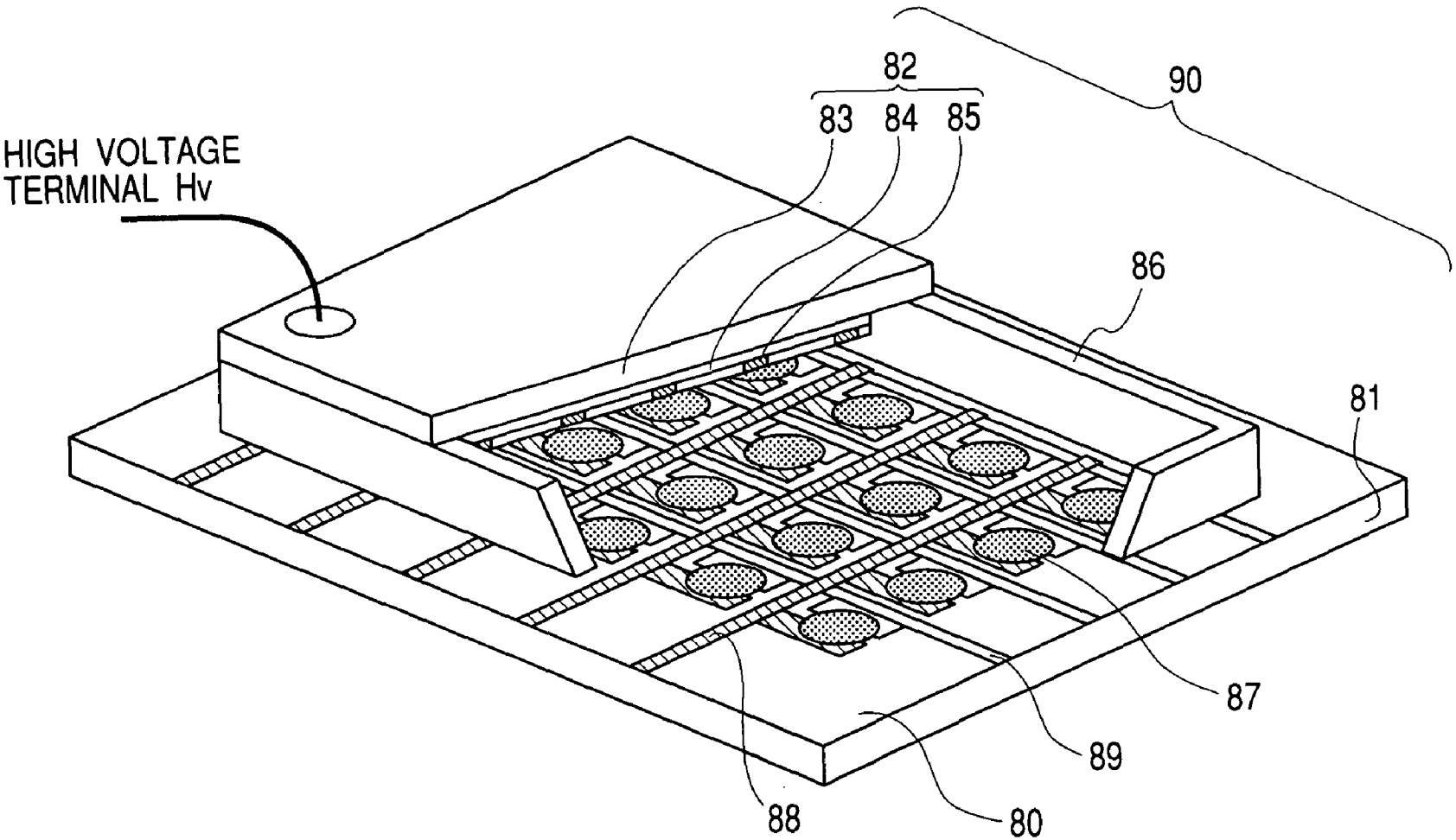
FIG. 9 is a schematic diagram showing the structure of a display panel of an image display apparatus according to the invention.

In FIG. 9, reference numeral 80 represents an electron source substrate having a number of electron emitting devices disposed thereon, and 81 represents a glass substrate called a rear plate. Reference numeral 82 represents a face plate made of a glass substrate 83 on which inner surface a phosphor film 84, a metal back 85 and the like are formed. Reference numeral 86 represents a support frame. The rear plate 81, support frame 86 and face plate 82 are bonded together by frit glass and baked for 10 minutes or longer at 400° C. to 500° C. to seal them and form an envelope 90.

These assembly processes are all performed in a vacuum chamber so that the inside of the envelope 90 can be made vacuum and the processes can be simplified.

In FIG. 9, reference numeral 87 represents the electron emitting devices manufactured by the method of the invention. Reference numerals 88 and 89 represent X- and Y-direction wiring lines connected to pairs of device electrodes of the surface conduction electron emitting devices.

An unrepresented support member called a spacer is disposed between the face plate 82 and rear plate 81. The envelope 90 even for a large area panel having a sufficient strength against the atmospheric pressure can be structured.

Figure 10A:
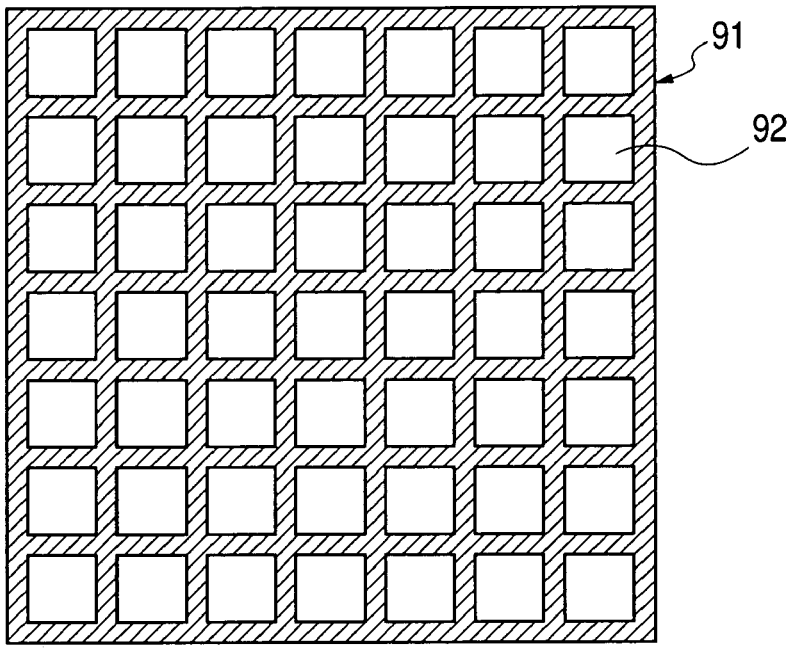
FIGS. 10A and 10B are schematic diagrams showing a phosphor film formed on a face plate.
Figure 10B:
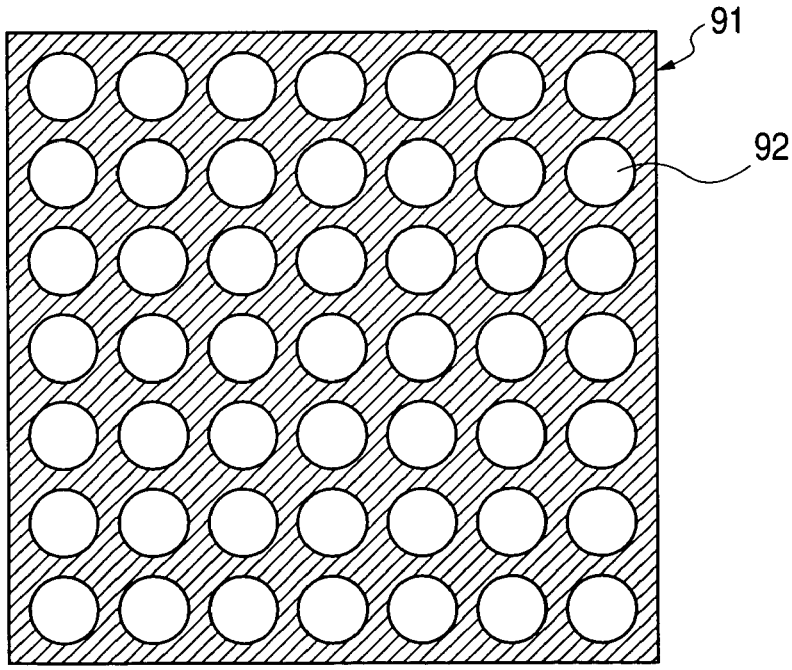

FIGS. 10A and 10B are diagrams illustrating phosphor films formed on face plates. A phosphor film 84 is made of only phosphor for a monochromatic phosphor film, and for a color phosphor film it is made of phosphors 92 and a black conductor 91 called a black stripe or a black matrix depending upon the phosphor pattern. The black strip or black matrix is formed in order not to make color mixture conspicuous by making black the area between coated phosphors 92, and in order to suppress the contrast from being lowered by external light reflection at the phosphor film 84.

A metal back 85 is generally formed on the inner surface of the phosphor film 84. The metal back is formed in order to improve the brightness by making light incident upon the inner side among radiated light from the phosphor, being mirror reflected at the glass substrate 82, in order to use it as the anode electrode to which an electron beam acceleration voltage is applied, and for other purposes. The metal back can be formed by performing a smoothing process (generally called a filming process) of the inner surface of the phosphor film after the phosphor film is formed, and thereafter by depositing aluminum by vapor deposition or the like.

For the sealing process described above, proper position alignment is performed between each color phosphor and each electron emitting device of the color panel by an upper and lower substrate abutting method or the like.

The vacuum degree in the sealing process is required to be about $10^{-7}$ Torr (abut $10^{-5}$ Pa). A gettering process is sometimes performed in order to maintain the vacuum degree after sealing the envelope 90. Immediately before or after sealing of the envelope 90, a getter disposed at a predetermined position (not shown) of the envelope is heated by a heating method such as resistor heating and high frequency heating to thereby form a vapor deposited film. The getter has usually Ba or the like as its main composition. With the absorption function of the vapor deposited film, the vacuum degree of, for example, $1\times10^{-5}$ to $1\times10^{-7}$ Torr ($10^{-3}$ to $10^{-5}$ Pa), is maintained.

(Image Display Device)

An electron emitting device can be used as an image display device. According to the fundamental characteristics of a surface conduction electron emitting device of the invention, electrons emitted from the electron emitting region are controlled, in the range from a threshold voltage to a higher voltage, by the wave height and width of a pulse voltage to be applied between opposing device electrodes.

A current amount can be controlled also at an intermediate value of this control voltage range so that half tone rendering is possible.

In the apparatus having a number of electron emitting devices, a selection line is determined by each scan line signal and a proper pulse voltage is applied to a desired device via each-information signal line to thereby turn on the device.

A method of modulating an electron emitting device in accordance with an input signal having a half tone signal includes a voltage demodulation method, a pulse width modulation method and the like.

As described so far, according to the present invention, it is possible to provide a method of manufacturing electron emitting devices having an excellent uniformity of electron emitting characteristics by improving the formation of liquid droplets to be dispensed to a substrate.

Also, according to the present invention, it is possible to provide a method of manufacturing image display devices having an excellent uniformity of display characteristics by improving the formation of liquid droplets to be dispensed to a substrate.

What is claimed is:

1. A method for manufacturing an electron emitting device provided with an electroconductive thin film having an electron emitting region, said method comprising the steps of:

applying on a surface of a substrate a silane coupling agent which contains two or more acetoxy groups in a molecule; and thereafter dispensing liquid containing material for forming said electroconductive thin film onto said surface of said substrate.

2. The method for manufacturing an electron emitting device according to claim 1, wherein said step of dispensing the liquid is performed by an ink jet method.

3. A method for manufacturing an electron emitting device provided with an electroconductive thin film having an electron emitting region, said method comprising the steps of:

forming on a substrate a pair of electrodes having a gap between the electrodes;

applying a silane coupling agent onto a surface of said substrate with said pair of electrodes being formed thereon and onto said pair of electrodes, said silane coupling agent containing two or more acetoxy groups in a molecule; and thereafter apylying a liquid droplet containing material for forming an electroconductive thin film into said gap on the surface of said substrate and onto said pair of electrodes.

4. The method for manufacturing an electron emitting device according to claim 3, wherein said silane coupling agent is diacetoxydimethylsilane.

5. The method for manufacturing an electron emitting device according to claim 3, wherein said step of applying the liquid droplet is performed by an ink jet method.

6. A method for manufacturing an electron emitting device provided with an electroconductive thin film having an electron emitting region, said method comprising steps of:

applying onto a surface of a substrate a mixture of two or more silane coupling agents having different hydrolysis groups wherein one of said two or more silane coupling agents is a silane coupling agent which contains two or more acetoxy groups in a molecule; and thereafter dispensing liquid containing material for forming said electroconductive thin film onto said surface of said substrate.

7. The method for manufacturing an electron emitting device according to claim 6, wherein said step of dispensing the liquid is performed by an ink jet method.

8. The method for manufacturing an electron emitting device according to claim 6, wherein said silane coupling agent which contains two or more acetoxy groups in a molecule is diacetoxydimethylsilane.

9. A method for manufacturing an electron emitting device provided with an electroconductive thin film having an electron emitting region, said method comprising the steps of:

applying onto a surface of a substrate a mixture of two or more silane coupling agents having different hydrolysis groups wherein one of said two or more silane coupling agents contains an acetoxy group in a molecule and another contains an ethoxy group in a molecule; and thereafter dispensing liquid containing material for forming said electroconductive thin film onto said surface of said substrate.

10. A method for manufacturing an electron emitting device provided with an electroconductive thin film having an electron emitting region, said method comprising the steps of:

forming on a substrate a pair of electrodes having a gap between the electrodes;

applying a mixture of two or more silane coupling agents onto a surface of the substrate with said pair of electrodes being formed thereon and onto said pair of electrodes, said mixture of two or more silane coupling agents having different hydrolysis groups, wherein one of said two or more silane coupling agents is a silane coupling agent which contains two or more acetoxy groups in a molecule; and thereafter applying a liquid droplet containg material for forming an electroconductive thin film into said gap on the surface of said substrate and onto said pair of electrodes.

11. The method for manufacturing an electron emitting device according to claim 10, wherein said silane coupling agent which contains two or more acetoxy groups in a molecule is diacetoxydimethylsilane.

12. The method for manufacturing an electron emitting device according to claim 10, wherein the applying of the liquid droplet is performed by an ink jet method.

13. A method for manufacturing an electron emitting device provided with an electroconductive thin film having an electron emitting region, said method comprising the steps of:

forming on a substrate a pair of electrodes having a gap between the electrodes;

applying a mixture of two or more silane coupling agents onto a surface of the substrate with said pair of electrodes being formed thereon and onto said pair of electrodes, said mixture of two or more silane coupling agents having different hydrolysis groups, wherein one of said two or more silane coupling agents contains an acetoxy group in a molecule and another contains an ethoxy group in a molecule; and thereafter applying a liquid droplet containing material for forming an electroconductive thin film into said gap on the surface of said substrate and onto said pair of electrodes.

14. A method for manufacturing an image display apparatus said method comprising the steps of:

applying onto a surface of a substrate a silane coupling agent which contains two or more acetoxy groups in a molecule; and thereafter dispensing liquid containing material for forming said electroconductive thin film onto said surface of said substrate by an ink jet method.

15. A method for manufacturing an image display apparatus, said method comprising the steps of:

applying onto a surface of a substrate a mixture of two or more silane coupling agents having different hydrolysis groups, wherein one of said two or more silane coupling agents contains an acetoxy group in a molecule and another contains an ethoxy group in a molecule; and thereafter dispensing liquid containing material for forming said electroconductive thin film onto said surface of said substrate by an ink jet method.

16. A method for manufacturing an image display, said method comprising the steps of:

applying onto a surface of a substrate a mixture of two or more silane coupling agents having different hydrolysis groups, wherein one of said two or more silane coupling agents is a silane coupling agent which contains two or more acetoxy groups in a molecule; and thereafter dispensing liquid containing material for forming said electroconductive thin film onto said surface of said substrate by an ink jet method.

* * * * *